United States Patent [19]

Tice

[11] 4,149,306

[45] Apr. 17, 1979

[54] PORTABLE TENSIONING SYSTEM FOR PRODUCING PRE-STRESSED CONCRETE BEAMS

[75] Inventor: Ralph J. Tice, Altadena, Calif.

[73] Assignee: Charles Pankow, Inc., Altadena, Calif.

[21] Appl. No.: 875,626

[22] Filed: Feb. 6, 1978

[51] Int. Cl.[2] ..... B28B 23/04

[52] U.S. Cl. ..... 29/452; 249/97; 249/163; 264/228; 264/229; 425/111

[58] Field of Search ..... 425/111; 249/83, 156, 249/163, 97; 52/227–229; 264/228, 229; 29/452

[56] References Cited

U.S. PATENT DOCUMENTS

| | | | |
|---|---|---|---|
| 2,184,137 | 12/1939 | Brewer | 52/229 |
| 2,966,717 | 1/1961 | Fuller et al. | 425/111 |
| 3,319,387 | 5/1967 | Stewing et al. | 52/227 |
| 3,334,455 | 8/1967 | Russel | 52/227 |
| 3,827,132 | 8/1974 | Bratchell | 425/111 |
| 4,015,383 | 4/1977 | Crowley | 52/227 |

*Primary Examiner*—John McQuade
*Attorney, Agent, or Firm*—Ralph B. Pastoriza

[57] ABSTRACT

The portable tensioning system takes the place of permanently installed facilities including massive earth anchors for casting pre-stressed building units such as concrete beams. Such permanently installed casting beds must be demolished if they are to be subsequently removed. The portable system comprises a plurality of pre-cast modular segments with walls defining channels to serve as part of a casting bed. These segments are provided with longitudinal bores so that they can be transported to a building site, aligned in end to end relationship, and post-tensioned by passing strands through the aligned bores to provide an overall elongated casting bed. After the casting operation has been completed, the segments can be disassembled and transported to another site for re-use.

5 Claims, 6 Drawing Figures

PORTABLE TENSIONING SYSTEM FOR PRODUCING PRE-STRESSED CONCRETE BEAMS

This invention relates generally to building construction operations and more particularly to a portable tensioning system for producing pre-stressed concrete beams.

BACKGROUND OF THE INVENTION

In the construction of large commercial buildings such as parking structures and the like, the basic construction unit comprises pre-stressed concrete beams which may extend for fifty or sixty feet in length. Such beams are generally produced at the construction site and towards this end, there is initially provided a casting bed installation for forming the beams. The casting bed itself may extend for several hundred feet within large massive earth anchors at opposite ends of the bed for holding pre-tensioning wires utilized in providing the pre-stressed concrete beams. By providing an elongated casting bed of length constituting a multiple of the length of the beams, the pre-tensioning wires need only be pre-tensioned once preparatory to pouring concrete in the casting bed there being provided end to end divider forms periodically along the casting bed through which the pre-tensioning wires pass. After casting, the beams can be separated at the end forms.

Resistance to the pre-stressing forces resulting from pre-tensioning the wires preparatory to casting, as stated, requires massive abutments or anchors buried in the ground. Not only is such construction of the casting facility expensive, but the same is necessarily of a fixed length and thus production units must be fitted into the fixed distance between abutments. Moreover, the facilities must be demolished if they are to be removed.

BRIEF DESCRIPTION OF THE PRESENT INVENTION

Bearing the foregoing in mind, the present invention contemplates the provision of a portable tensioning system for producing pre-stressed concrete beams which avoids the foregoing disadvantages of the above-discussed prior art casting beds.

More particularly, the method of providing a portable tensioning system for producing pre-stressed concrete beams in accord with this invention includes pre-casting a plurality of individual elongated concrete segments which may be easily transported to a building site. Each segment is formed with at lest one channel serving as part of a casting bed and with a plurality of longitudinal bores passing from end to end through the walls and floor of the channel. A desired number of such segments can then be assembled at the building site in end to end relationship with the longitudinal openings in registration to define an elongated casting bed of any desired length. Finally, the post-tensioning strands are passed through the registered longitudinal bores and tensioned to stabilize the aligned segments.

End plates dimensioned to be received over the exposed end surfaces of the first and last aligned segments are provided, each end plate having an array of openings for receiving opposite ends of pre-tensioning wires in the channel for carrying the load of pre-tensioning preparatory to casting a plurality of beams in the channel. The aligned segments thus carry the pre-tensioning load in compression and the need for massive earth anchors and the like is wholly eliminated.

After construction is completed, the various segments can be disassembled and utilized at another site. The installation cost, change in location and pre-stressed material waste are all substantially reduced by the portable system of this invention.

BRIEF DESCRIPTION OF THE DRAWINGS

A better understanding of the portable tensioning system of this invention will be had by now referring to the accompanying drawings in which.

DETAILED DESCRIPTION OF THE PREFERRED EMBODIMENT

Figure 1:
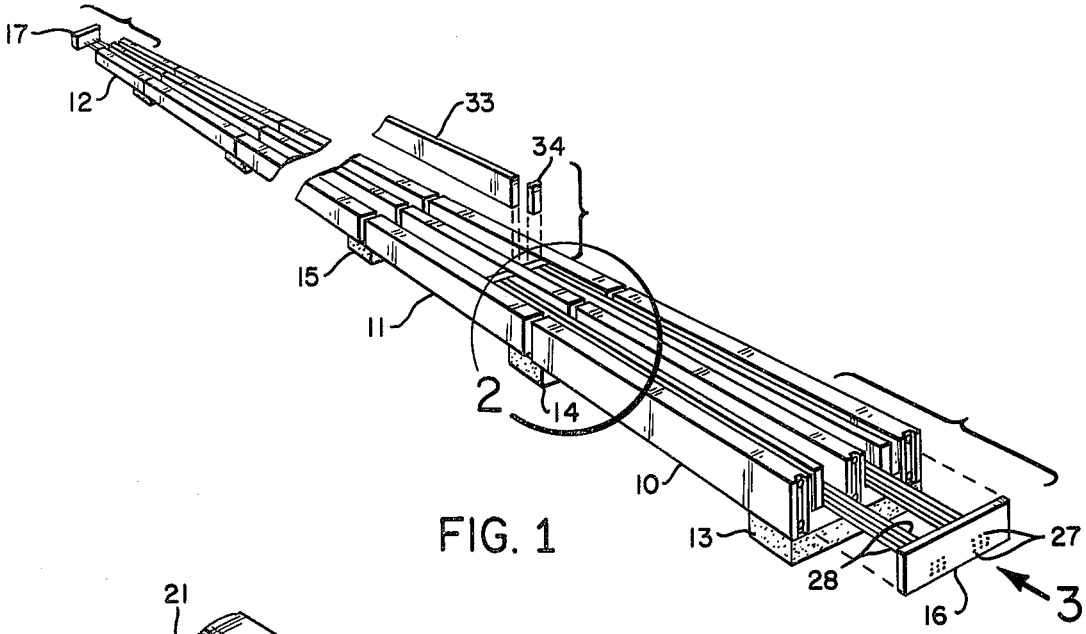
FIG. 1 is an overall perspective view partly exploded of an elongated casting bed made up of a plurality of segments placed in end to end relationship at a building site preparatory to producing pre-stressed concrete beams in accord with this invention.

Referring first to FIG. 1, there is shown a plurality of modular pre-cast elongated concrete segments 10, 11 . . . 12 assembled in end to end relationship along suitable foundation fittings such as indicated at 13, 14 and 15.

A pair of end plates 16 and 17 are each dimensioned to seat on the opposite exposed end surfaces of the first and last of the segments 10 and 12, these plates being shown in FIG. 1 exploded away from these end surfaces.

Each of the segments of FIG. 1 constitutes a pre-cast concrete structure capable of being transported to a building site, the segments being essentially modular in form; that is, all constructed of substantially the same dimensions so that a desired length overall casting bed can be provided at a construction site by assembling the necessary number of segments in end to end relationship as shown. Since the segments are all substantially identical, a detailed description of one will suffice for all.

Figure 2:
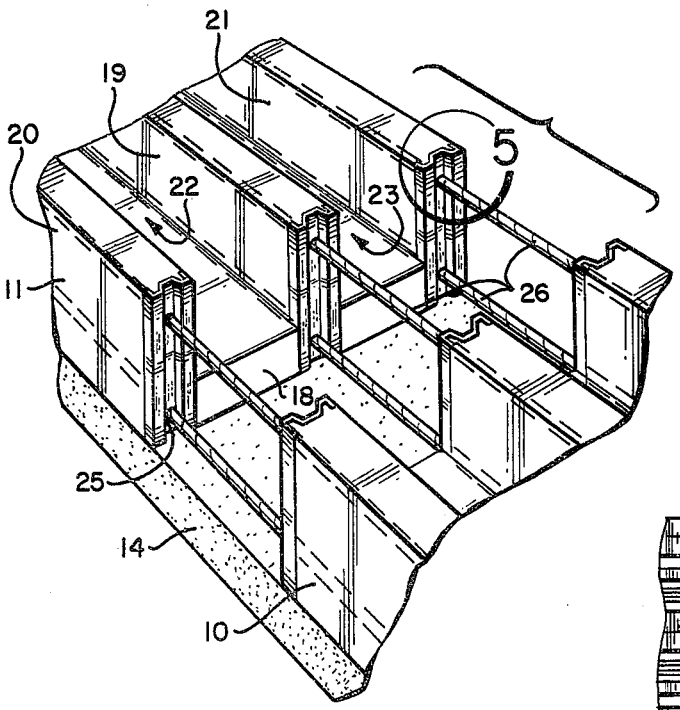
FIG. 2 is an enlarged fragmentary perspective view partly exploded of the portion enclosed by the circular arrow 2 of the casting bed of FIG. 1.

Thus, referring to the enlarged fragmentary view of FIG. 2 the segment 11 includes a base slab 18 with longitudinally running integrally formed center and outer walls 19 and 20, 21 extending upwardly from the center and outer longitudinal edges of the slab respectively. There are thus defined two parallel channels 22 and 23 between the center wall 19 and each outer wall 20 and 21 respectively.

Figure 3:
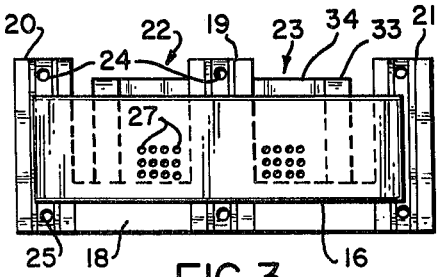
FIG. 3 is an end elevational view of the bed looking in the direction of the arrow 3 of FIG. 1.

As shown in both FIGS. 2 and 3, the upper portion of each wall has a longitudinal bore 24 passing therethrough to open out at each opposite end surface. Similarly, the base 18 is provided with a longitudinal bore 25 beneath the lower portions of each of the walls opening out at each opposite end surface. A plurality of post-tensioning strands 26 pass through the longitudinal bores as best illustrated in FIG. 2 for post-tensioning to stabilize the end to end aligned segments of FIG. 1.

With particular reference to FIG. 3, there is illustrated the end plate 16 referred to in FIG. 1. This end plate is dimensioned to seat on the exposed end surface of the segment 10 within the margin of the longitudinal bore openings for the bores 24 and 25. Further, each plate includes an array of openings 27 for receiving opposite ends of pre-tensioning wires shown at 28 in FIG. 1 running within the channels.

Figure 4:
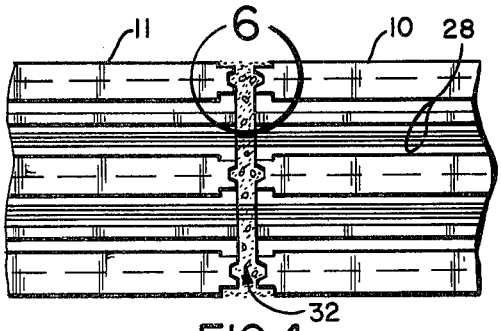
FIG. 4 is a top plan view of one of the joints between adjacent segments of the bed of FIG. 1.

FIG. 4 illustrates the array of pre-tensioning wires 28 wherein it will be evident that they extend continuously past each of the various juxtaposed joints between adjacent segments such as the segments 10 and 11.

Figure 5:
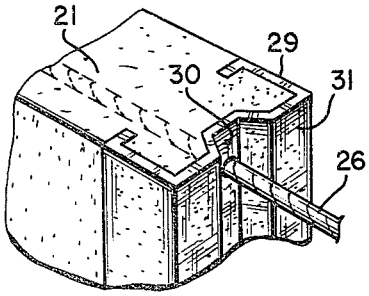
FIG. 5 is an enlarged fragmentary perspective view of the portion enclosed within the circular arrow 5 of FIG. 2; and, FIG. 6 is an enlarged fragmentary plan view of a portion enclosed within the circular arrow 6 of FIG. 4.

Referring now specifically to FIG. 5, in order to increase the stability at the various joints of the juxtaposed end surfaces of the segments, each end surface has cast therein a vertical keying plate 29 defining a vertical central groove 30. This groove and end surface defined by the keying plate 29 is provided with a bond breaking composition 31.

Figure 6:
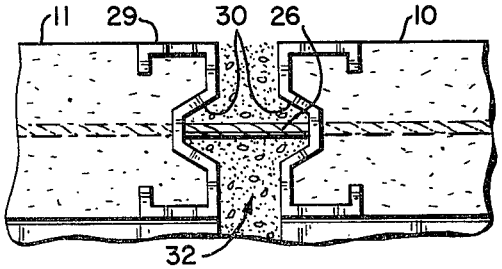

Referring now to FIG. 6, there is illustrated grout 32 filling the opposed end surfaces defined by the keying plates 29 and the opposed grooves 30. The cured grout will inhibit any lateral shifting of the aligned segments relatively to each other.

OPERATION

When each of the pre-cast segments such as 10 and 11 shown in FIG. 1 are formed, the channels defined between the walls are wider than that of a normally contemplated pre-stressed concrete beam to be produced. Thus, in actuality only two surfaces of the channel serve as forms for the beam, the remaining side and end surfaces being defined by appropriate forms illustrated in exploded view in FIG. 1 and 33 and 34.

These forms provide for a flexibility in dimensioning the various concrete beams to be produced. Thus, referring to FIG. 3 there are shown the side and end forms 33 and 34 of FIG. 1 in place wherein the opposite outer surfaces of the center wall 19 and floor of the slab 18 serve as two casting surfaces while the remaining surfaces are defined by the forms 33 and 34. The width or thickness of the beams is thus determined by the positioning of the form 33 from the surface of the center wall while the length of the beam depends on the positioning of the end form 34 along the elongated casting bed.

As described earlier, the various individual segments of the portable tensioning system are initially transported to a building site and thence assembled in end to end relationship. Thereafter, the post tensioning strands 26 described in FIG. 2 are passed through the aligned registered longitudinal bores of the various segments and post tensioned to draw the segments tightly into stabilized alignment. Grout may be utilized as described in FIG. 6 to further stabilize the joints and inhibit any subsequent lateral shifting thereof.

The appropriate forms such as 33 and 34 may then be disposed along the channel beds to define the desired dimensioned beams to be produced. The opposite ends of the pre-tensioning wires 28 laid in the channels are then passed through the array of openings in the end plates and pre-tensioned preparatory to casting the beams. In this respect, the pre-tensioning forces are accomodated by the aligned segments in compression so that the need of earth anchors and the like is wholly eliminated.

After pre-tensioning of the wires 28 has been complated, the casting operation may take place.

After sufficient curing of the cast beams has taken place to hold the pre-tensioned wires, these wires are severed at the end forms defining the lengths of the beams and the beams removed. A new set of pre-tensioning wires can then be positioned in the channels and pre-tensioned between the end plates and the process repeated.

After all casting operations have been completed, the various segments are separated by simply cutting the post-tensioning strands 26 at the juxtaposed ends of the segments defining the joints. These post-tensioning strands are removed and the various segments then individually transported to another site for subsequent casting operations at which point new strands are passed through the aligned longitudinal bores of the segments after assembly.

From all of the foregoing, it will thus be evident that the present invention has provided a cost-saving portable tensioning system for producing pre-stressed concrete beams or similar building construction units wherein the various disadvantages heretofore set forth with permanently installed facilities are avoided.

I claim:

1. A method of providing a portable tensioning system for producing concrete beams including the steps of:

(a) precasting a plurality of individual elongated concrete segments which may be transported to a building site, each segment being formed with at least one channel serving as a casting bed and with a plurality of longitudinal bores passing from end to end through the walls and floor of the channel;

(b) assembling a desired number of said segments in end to end relationship so that the openings of the longitudinal bores register to define an elongated casting bed of desired length;

(c) passing and post-tensioning strands through the registered longitudinal bores to stabilize the assembly of segments;

(d) providing end plates dimensioned to be received over the exposed end surfaces of the first and last aligned segments within the margin of the end openings of said longitudinal bores, said end plates each having an array of openings;

(e) providing pre-tensioning wires in said channel with opposite ends of said pre-tensioning wires passing through said array of openings in said end plates; and (f) pre-tensioning said pre-tensioning wires whereby said end plates and said segments carry the load of pre-tensioning preparatory to casting a plurality of beams in said channel thereby eliminating the need for earth anchors.

2. The method of claim 1, including the further steps of providing vertical grooves in the end surfaces of each segment; applying a bond breaker composition to said end surfaces; and filling the joint and resulting grooves between juxtaposed end surfaces of the segments after alignment with grout to stabilize the joints and inhibit relative lateral shifting between the segments.

3. A portable tensioning system for producing pre-stressed concrete beams including, in combination:

(a) a plurality of modular pre-cast concrete segments capable of being portably transferred to a building site, each segment comprising a base slab with longitudinally running integrally formed parallel spaced walls extending upwardly from the slab to define at least one longitudinal channel to serve as part of a casting bed, and a plurality of longitudinal bores passing from end to end through the walls;

(b) a plurality of post-tensioning strands for passing through said longitudinal bores and compressing the segments after a desired number of said segments is assembled in end to end relationship, to thereby define an elongated channel serving as a casting bed for producing a number of beams; and, (c) a pair of end plates dimensioned to seat on the opposite exposed end surfaces of the aligned segments, said plates each including an array of openings for receiving opposite ends of pre-tensioning wires extending the length of the assembled segments so that the same may be tensioned preparatory to casting beams, the end to end segments accomodating the tensioning load in compression so that the need for earth anchors is eliminated.

4. A portable tensioning system for producing prestressed concrete beams including, in combination:

(a) a plurality of modular precast elongated concrete segments, each segment comprising a base slab with longitudinally running integrally formed center and outer walls extending upwardly from the center and outer longitudinal edges of the slab respectively to define two parallel channels between the center and each outer wall, the opposite ends of the segment terminating in end surfaces, the upper portion of each wall having a longitudinal bore passing therethrough to open out at each opposite end surface, and said base slab having a longitudinal bore spaced beneath the lower portions of each of the walls similarly opening out at each opposite end surface;

(b) a plurality of post-tensioning strands; and (c) a pair of flat end plates each dimensioned to seat on an end surface of a segment within the margin of the longitudinal bore openings, and each including openings receiving opposite ends of pre-tensioning wires running within said channels whereby any desired number of said segments may be assembled and secured in end to end relationship by passing said strands through the aligned longitudinal bores of the segments and post-tensioning said strands to thereby provide an overall elongated casting bed with the channels of the segments all in alignment, said end plates being received at the exposed ends of the first and last of the segments for pre-tensioning wires preparatory to casting a plurality of concrete beams in each of said channels, said aligned segments absorbing by compression the pre-tensioning forces in said wires to thereby eliminate the need for earth anchors.

5. A system according to claim 4, in which the end surfaces of each wall of each segment has cast therein a vertical keying plate defining a vertical central groove such that when a number of segments are aligned, the opposed vertical grooves of the keying plates on the juxtaposed ends of the segments can be filled with grout to further stabilize the end to end assembly and inhibit any lateral shifting of the aligned segments relative to each other.

* * * * *